US008605548B2

(12) United States Patent
Froelich

(10) Patent No.: US 8,605,548 B2
(45) Date of Patent: Dec. 10, 2013

(54) BI-DIRECTIONAL WIRELESS ACOUSTIC TELEMETRY METHODS AND SYSTEMS FOR COMMUNICATING DATA ALONG A PIPE

(75) Inventor: Benoit Froelich, Marly le Roi (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 594 days.

(21) Appl. No.: 12/613,548

(22) Filed: Nov. 6, 2009

(65) Prior Publication Data

US 2011/0176387 A1 Jul. 21, 2011

Related U.S. Application Data

(60) Provisional application No. 61/112,568, filed on Nov. 7, 2008.

(51) Int. Cl.
*E21B 47/16* (2006.01)

(52) U.S. Cl.
USPC ..... 367/82; 367/165; 340/854.4

(58) Field of Classification Search
USPC ..... 367/81–83, 165; 166/250.01, 313; 340/854.4
See application file for complete search history.

(56) References Cited

U.S. PATENT DOCUMENTS

| | | | | |
|---|---|---|---|---|
| 5,050,132 | A | | 9/1991 | Duckworth |
| 5,056,067 | A | | 10/1991 | Drumheller |
| 5,124,953 | A | | 6/1992 | Grosso |
| 5,128,901 | A | | 7/1992 | Drumheller |
| 5,128,902 | A | | 7/1992 | Spinnler |
| 5,148,408 | A | | 9/1992 | Matthews |
| 5,222,049 | A | | 6/1993 | Drumheller |
| 5,274,606 | A | | 12/1993 | Drumheller |
| 5,293,937 | A | | 3/1994 | Schultz et al. |
| 5,477,505 | A | | 12/1995 | Drumheller |
| 5,568,448 | A | | 10/1996 | Tanigushi et al. |
| 5,592,438 | A | * | 1/1997 | Rorden et al. ..... 367/83 |
| 5,675,325 | A | | 10/1997 | Taniguchi et al. |
| 5,703,836 | A | | 12/1997 | Drumheller |
| 5,815,035 | A | | 9/1998 | Yamagishi et al. |
| 5,850,369 | A | * | 12/1998 | Rorden et al. ..... 367/83 |
| 5,923,937 | A | | 7/1999 | Thompson et al. |
| 5,941,307 | A | | 8/1999 | Tubel |
| 5,995,449 | A | | 11/1999 | Green et al. |
| 6,108,268 | A | * | 8/2000 | Moss ..... 367/82 |
| 6,137,747 | A | | 10/2000 | Shah et al. |

(Continued)

FOREIGN PATENT DOCUMENTS

| | | |
|---|---|---|
| EP | 0636763 | 2/1995 |
| EP | 0550521 | 8/1995 |

(Continued)

*Primary Examiner* — Albert Wong
(74) *Attorney, Agent, or Firm* — Cameron R. Sneddon; Diana M. Sangalli

(57) ABSTRACT

A bi-directional acoustic telemetry system is presented for communicating data and/or control signals between a first modem and a second modem along tubing. The system includes a communication channel defined by the tubing, a transducer of the first modem, and a transducer of the second modem. The transducer of each modem are configured to transmit and receive data and/or control signals, and are further configured to electrically communicate with a power amplifier characterized by an output impedance Zs and a signal conditioning amplifier characterized by an input impedance Zr. The system also includes a reciprocal response along the communication channel between the output impedance Zs and the input impedance Zr.

19 Claims, 6 Drawing Sheets

(56) References Cited

U.S. PATENT DOCUMENTS

| | | | | |
|---|---|---|---|---|
| 6,147,932 | A | 11/2000 | Drumheller | |
| 6,188,647 | B1 | 2/2001 | Drumheller | |
| 6,192,988 | B1 | 2/2001 | Tubel | |
| 6,272,916 | B1 | 8/2001 | Taniguchi et al. | |
| 6,320,820 | B1 | 11/2001 | Gardner et al. | |
| 6,321,838 | B1 | 11/2001 | Skinner | |
| 6,791,470 | B1 * | 9/2004 | Drumheller | 340/854.4 |
| 6,847,585 | B2 | 1/2005 | Macpherson | |
| 6,912,177 | B2 | 6/2005 | Smith | |
| 6,937,159 | B2 * | 8/2005 | Hill et al. | 340/854.4 |
| 6,998,999 | B2 * | 2/2006 | Fripp et al. | 340/854.4 |
| 7,325,605 | B2 * | 2/2008 | Fripp et al. | 166/250.01 |
| 7,595,737 | B2 * | 9/2009 | Fink et al. | 340/854.4 |

FOREIGN PATENT DOCUMENTS

| | | |
|---|---|---|
| EP | 1076245 | 2/2001 |
| EP | 1193368 | 4/2002 |
| EP | 0773345 | 4/2003 |
| EP | 1882811 | 1/2008 |
| WO | 9206275 | 4/1992 |
| WO | 9624751 | 8/1996 |
| WO | 0077345 | 12/2000 |
| WO | 0139412 | 5/2001 |
| WO | 0227139 | 4/2002 |
| WO | 2005005724 | 1/2005 |
| WO | 2007095111 | 8/2007 |

* cited by examiner

BI-DIRECTIONAL WIRELESS ACOUSTIC TELEMETRY METHODS AND SYSTEMS FOR COMMUNICATING DATA ALONG A PIPE

CROSS-REFERENCE TO RELATED APPLICATION

The present application is based on and claims priority to U.S. Provisional Patent Application No. 61/112,568, filed Nov. 7, 2008.

TECHNICAL FIELD

The present invention relates generally to wireless acoustic telemetry methods and systems for communicating data along a pipe, said methods and systems being used in a wellbore to communicate data between equipment at the surface and downhole equipment positioned in the wellbore.

BACKGROUND ART

Downhole testing is traditionally performed in a "blind fashion": downhole tools and sensors are deployed in a well at the end of a tubing string for several days or weeks after which they are retrieved at surface. During the downhole testing operations, the sensors may record measurements that will be used for interpretation once retrieved at surface. It is only after the downhole testing tubing string is retrieved that the operators will know whether the data is sufficient and not corrupted. Similarly when operating some of the downhole testing tools from surface, such as tester valves, circulating valves, packers, samplers or perforating charges, the operators do not obtain a direct feedback from the downhole tools.

In this type of downhole testing operations, the operator can greatly benefit from having a two-way communication between surface and downhole. However, it can be difficult to provide such communication using a cable since inside the tubing string it limits the flow diameter and requires complex structures to pass the cable from the inside to the outside of the tubing. Space outside the tubing is limited and cable can easily be damaged. Therefore a wireless telemetry system is preferred.

There are three major methods of wireless data transfer from downhole to surface (or vice versa): mud pulse, electromagnetic and acoustic telemetry.

A number of proposals have been made for wireless telemetry systems based on acoustic and/or electromagnetic communications. Examples of various aspects of such systems can be found in: U.S. Pat. No. 5,050,132; U.S. Pat. No. 5,056,067; U.S. Pat. No. 5,124,953; U.S. Pat. No. 5,128,901; U.S. Pat. No. 5,128,902; U.S. Pat. No. 5,148,408; U.S. Pat. No. 5,222,049; U.S. Pat. No. 5,274,606; U.S. Pat. No. 5,293,937; U.S. Pat. No. 5,477,505; U.S. Pat. No. 5,568,448; U.S. Pat. No. 5,675,325; U.S. Pat. No. 5,703,836; U.S. Pat. No. 5,815,035; U.S. Pat. No. 5,850,369; U.S. Pat. No. 5,923,937; U.S. Pat. No. 5,941,307; U.S. Pat. No. 5,995,449; U.S. Pat. No. 6,137,747; U.S. Pat. No. 6,147,932; U.S. Pat. No. 6,188,647; U.S. Pat. No. 6,192,988; U.S. Pat. No. 6,272,916; U.S. Pat. No. 6,320,820; U.S. Pat. No. 6,321,838; U.S. Pat. No. 6,847,585; U.S. Pat. No. 6,912,177; EP0636763; EP0773345; EP1076245; EP1193368; EP1320659; WO96/024751; WO92/06275; WO05/05724; WO02/27139; WO01/39412; WO00/77345; WO07/095111.

In EP0550521, an acoustic telemetry system is used to pass data across an obstruction in the tubing, such as a valve. The data is then stored for retrieval by a wireline tool passed inside the tubing from the surface. It is also proposed to retransmit the signal as an acoustic signal. EP1882811 discloses an acoustic transducer structure that can be used as a repeater along the tubing.

It is an aim of the present invention to provide an acoustic communication method and a system that overcomes the limitations of existing devices to allow a bi-directional communication of data between a downhole location and a surface location.

BRIEF DISCLOSURE OF THE INVENTION

In a first aspect, embodiments disclosed herein relate to a bi-directional acoustic telemetry system for communicating data and control signals between a first modem and a second modem along tubing, the system comprising a communication channel comprising the tubing, a transducer of the first modem, and a transducer of the second modem. The transducer of each modem is configured to transmit and receive said data and/or control signals, and the transducer of each modem is further configured to electrically communicate with a power amplifier characterized by an output impedance Zs and a signal conditioning amplifier characterized by an input impedance Zr. The system preferably comprises a reciprocal response along the communication channel between the output impedance Zs and the input impedance Zr.

In a second aspect, embodiments disclosed herein relate to a testing installation for a well comprising a well-head equipment, tubing which extends from the well-head equipment down inside the well to the zone of interest and downhole test equipment connected to the tubing, wherein it further comprises a bi-directional acoustic telemetry system according to the first aspect for communicating between downhole equipment and the well-head equipment.

In a third aspect, embodiments disclosed herein relate to a method for bi-directional acoustic communication between a first modem and a second modem along tubing, wherein each said modem comprises a transducer for transmitting and receiving acoustic signals. The method preferably comprises the steps of determining an output impedance Zs of the transducer of each modem; determining an input impedance Zr of the transducer of each modem equal to the output impedance Zs of the transducer; and transmitting an acoustic signal between the first modem and the second modem along the tubing.

In a fourth aspect, embodiments disclosed herein relate to a bi-directional acoustic telemetry system for communicating data and/or control signals between a first modem and a second modem along tubing, wherein each said modem comprises a transducer for transmitting and receiving said data and control signals, and wherein the transducer of each said modem is configured to electrically communicate with a power amplifier characterized by an output impedance Zs for driving said data and/or control signal, and a signal conditioning amplifier characterized by an input impedance Zr for receiving said data and/or control signal, and wherein the output impedance Zs is configured to have channel reciprocity with the input impedance Zr.

Other aspects, characteristics, and advantages of the present invention will be apparent from the following detailed description and the appended claims.

BRIEF DESCRIPTION OF DRAWINGS

Certain embodiments of the present invention will hereafter be described with reference to the accompanying drawings, wherein like reference numerals denote like elements, and.

DETAILED DESCRIPTION

Figure 1:
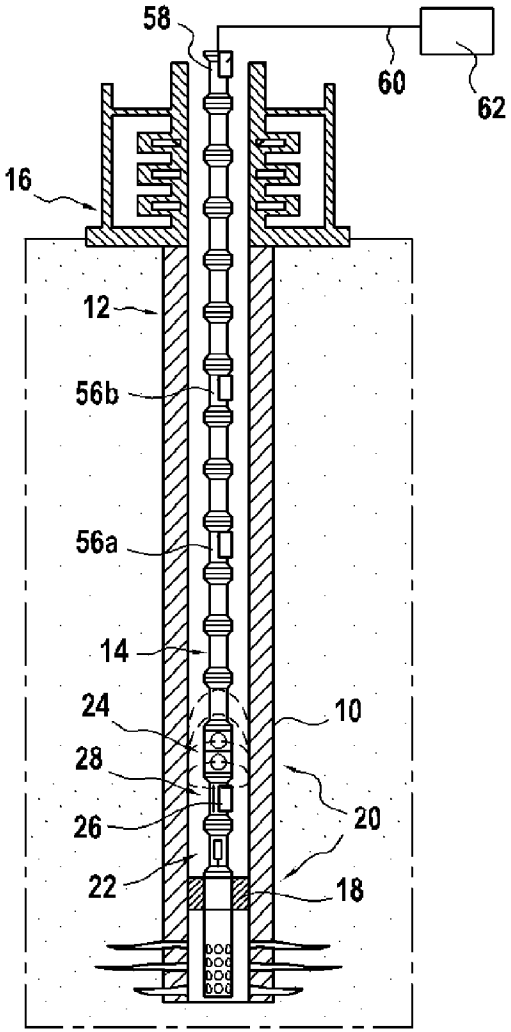
FIG. 1 shows a schematic view of a downhole testing system constructed in accordance with an embodiment of the present invention.

The present invention is particularly applicable to testing installations such as are used in oil and gas wells or the like. FIG. 1 shows a schematic view of such a system. Once the well has been drilled through a formation, the drill pipe can be used to perform tests, and determine various properties of the formation through which the well has been drilled. In the example of FIG. 1, the well 10 has been lined with a steel casing 12 (cased hole) in the conventional manner, although similar systems can be used in unlined (open hole) environments. In order to test the formations, it is preferable to place testing apparatus in the well close to the regions to be tested, to be able to isolate sections or intervals of the well, and to convey fluids from the regions of interest to the surface. This is commonly done using a jointed tubular drill pipe, drill string, production tubing, or the like (collectively, tubing 14) which extends from the well-head equipment 16 at the surface (or sea bed in subsea environments) down inside the well to the zone of interest. However, may also be done using production tubing. The term "drill pipe," "pipe," or "tubing" as used herein is meant to generically describe any conduit, tubing or piping through which fluids may be conveyed from the formation to surface. The well-head equipment 16 can include blow-out preventers and connections for fluid, power and data communication.

A packer 18 is positioned on the tubing 14 and can be actuated to seal the borehole around the tubing 14 at the region of interest. Various pieces of downhole test equipment 20 are connected to the tubing 14 above or below the packer 18. Such downhole equipment 20 may include, but is not limited to, additional packers, tester valves, circulation valves, downhole chokes, firing heads, TCP (tubing conveyed perforator) gun drop subs, samplers, pressure gauges, downhole flow meters, downhole fluid analyzers, and the like.

In the embodiment of FIG. 1, a sampler 22 is located above the packer 18 and a tester valve 24 located above the packer 18. The downhole equipment 20 is connected to an electroactive element, such as a downhole modem 26 which may be mounted in a gauge carrier 28 positioned between the sampler 22 and tester valve 24. The modem 26, also referred to as an acoustic transceiver or transducer, operates to allow electrical signals from the equipment 20 to be converted into acoustic signals for transmission to the surface via the tubing 14, and to convert acoustic tool control signals from the surface into electrical signals for operating the downhole equipment 20. The term "data," as used herein, is meant to encompass control signals, tool status, and any variation thereof whether transmitted via digital or analog.

Figure 2:
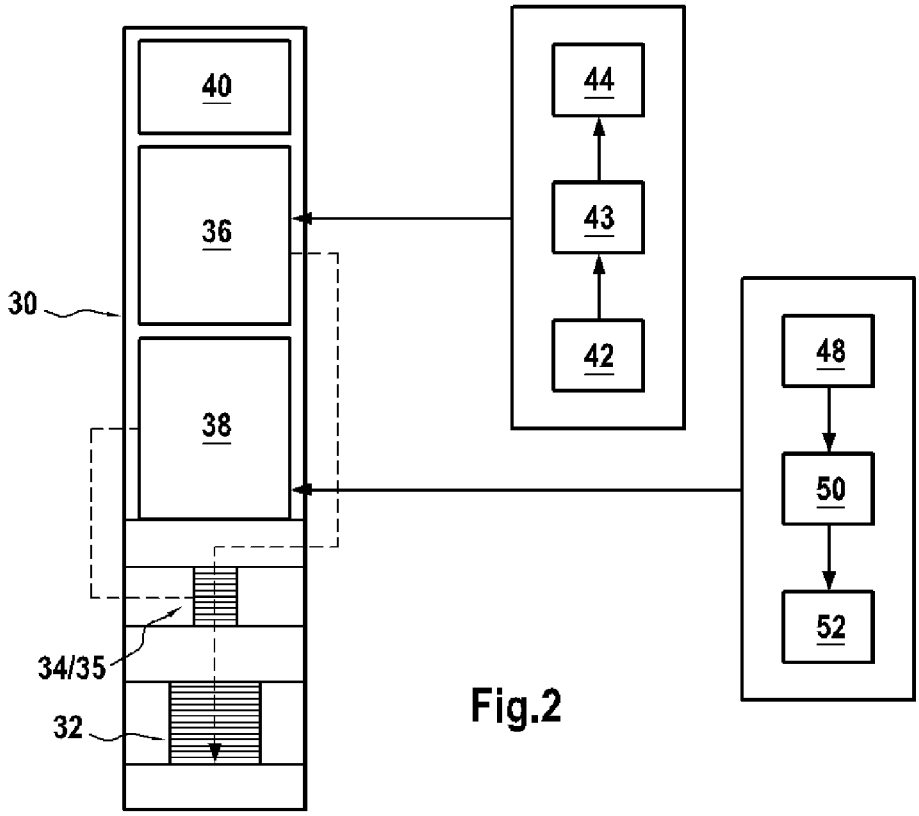
FIG. 2 shows a schematic view of a modem as used in accordance with the embodiment of FIG. 1.

FIG. 2 shows a schematic of the modem 26 in more detail. The modem 26 comprises a housing 30 supporting a piezo electric actuator or stack 32 which can be driven to create an acoustic signal in the tubing 14. The modem 26 can also include an accelerometer 34 or monitoring piezo sensor 35 for receiving acoustic signals. Where the modem 26 is only required to act as a receiver, the piezo actuator 32 may be omitted. Transmitter electronics 36 and receiver electronics 38 are also located in the housing 30 and power is provided by means of a battery, such as a lithium rechargeable battery 40. Other types of power supply may also be used.

The transmitter electronics 36 are arranged to initially receive an electrical output signal from a sensor 42, for example from the downhole equipment 20 provided from an electrical or electro/mechanical interface. Such signals are typically digital signals which can be provided to a microcontroller 43 which modulates the signal in one of a number of known ways PSK, QPSK, QAM, and the like. The resulting modulated signal is amplified by either a linear or non-linear amplifier 44 and transmitted to the piezo stack 32 so as to generate an acoustic signal in the material of the tubing 14.

The acoustic signal that passes along the tubing 14 as a longitudinal and/or flexural wave comprises a carrier signal with an applied modulation of the data received from the sensors 42. The acoustic signal typically has, but is not limited to, a frequency in the range 1-10 kHz, preferably in the range 2-5 kHz, and is configured to pass data at a rate of, but is not limited to, about 1 bps to about 200 bps, preferably from about 5 to about 100 bps, and more preferably about 50 bps. The data rate is dependent upon conditions such as the noise level, carrier frequency, and the distance between the repeaters. A preferred embodiment of the present invention is directed to a combination of a short hop acoustic telemetry system for transmitting data between a hub located above the main packer 18 and a plurality of downhole tools and valves below and/or above said packer 18. Then the data and/or control signals can be transmitted from the hub to a surface module either via a plurality of repeaters as acoustic signals or by converting into electromagnetic signals and transmitting straight to the top. The combination of a short hop acoustic with a plurality of repeaters and/or the use of the electromagnetic waves allows an improved data rate over existing systems. The system may be designed to transmit data as high as 200 bps. Other advantages of the present system exist.

The receiver electronics 38 are arranged to receive the acoustic signal passing along the tubing 14 produced by the transmitter electronics of another modem. The receiver electronics 38 are capable of converting the acoustic signal into an electric signal. In a preferred embodiment, the acoustic signal passing along the tubing 14 excites the piezo stack 32 so as to generate an electric output signal (voltage); however, it is contemplated that the acoustic signal may excite an accelerometer 34 or an additional piezo stack 35 so as to generate an electric output signal (voltage). This signal is essentially an analog signal carrying digital information. The analog signal is applied to a signal conditioner 48, which operates to filter/condition the analog signal to be digitalized by an A/D (analog-to-digital) converter 50. The A/D converter 50 provides a digitalized signal which can be applied to a microcontroller 52. The microcontroller 52 is preferably adapted to demodulate the digital signal in order to recover the data provided by the sensor 42 connected to another modem, or provided by the surface. The type of signal processing depends on the applied modulation (i.e. PSK, QPSK, QAM, and the like).

The modem 26 can therefore operate to transmit acoustic data signals from the sensors in the downhole equipment 20 along the tubing 14. In this case, the electrical signals from the equipment 20 are applied to the transmitter electronics 36 (described above) which operate to generate the acoustic signal. The modem 26 can also operate to receive acoustic control signals to be applied to the downhole equipment 20. In this case, the acoustic signals are demodulated by the receiver electronics 38 (described above), which operate to generate the electric control signal that can be applied to the equipment 20.

In order to support acoustic signal transmission along the tubing 14 between the downhole location and the surface, a series of repeater modems 56*a*, 56*b*, etc. may be positioned along the tubing 14. These repeater modems 56*a* and 56*b* can operate to receive an acoustic signal generated in the tubing 14 by a preceding modem and to amplify and retransmit the signal for further propagation along the drill string. The number and spacing of the repeater modems 56*a* and 56*b* will depend on the particular installation selected, for example on the distance that the signal must travel. A typical spacing between the modems is around 1,000 ft, but may be much more or much less in order to accommodate all possible testing tool configurations. When acting as a repeater, the acoustic signal is received and processed by the receiver electronics 38 and the output signal is provided to the microcontroller 52 of the transmitter electronics 36 and used to drive the piezo stack 32 in the manner described above. Thus an acoustic signal can be passed between the surface and the downhole location in a series of short hops.

The role of a repeater is to detect an incoming signal, to decode it, to interpret it and to subsequently rebroadcast it if required. In some implementations, the repeater does not decode the signal but merely amplifies the signal (and the noise). In this case the repeater is acting as a simple signal booster. However, this is not the preferred implementation selected for wireless telemetry systems of the present invention.

Repeaters are positioned along the tubing/piping string. A repeater will either listen continuously for any incoming signal or may listen from time to time.

Referring again to FIG. 1, a surface modem 58 is provided at the well head 16 which provides a connection between the tubing 14 and a data cable or wireless connection 60 to a control system 62 that can receive data from the downhole equipment 20 and provide control signals for its operation.

Figure 3:
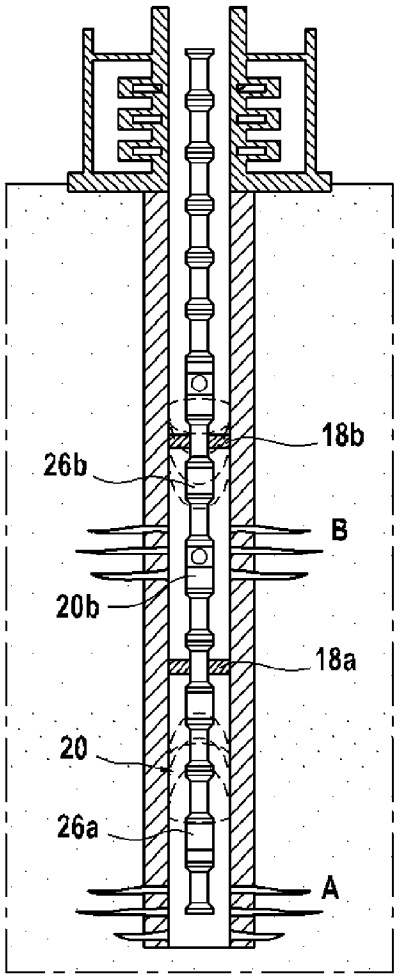
FIG. 3 shows a variant of the embodiment of FIG. 1.

In the embodiment of FIG. 1, the acoustic telemetry system is used to provide communication between the surface and the downhole location. FIG. 3 shows another embodiment in which acoustic telemetry is used for communication between tools in multi-zone testing. In this case, two zones A, B of the well are isolated by means of packers 18*a*, 18*b*. Test equipment 20*a*, 20*b* is located in each isolated zone A, B, corresponding modems 26*a*, 26*b* being provided in each case. Operation of the modems 26*a*, 26*b* allows the equipment 20*a*, 20*b* in each zone to communicate with each other as well as allowing communication from the surface with control and data signals in the manner described above.

Figure 5:
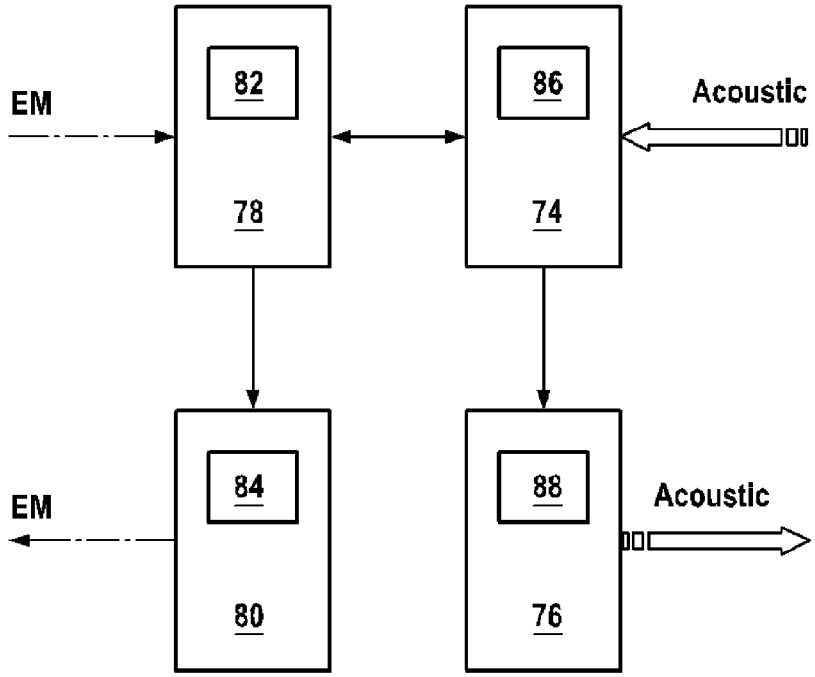
FIG. 5 shows a schematic view of a modem as used in the embodiment of FIG. 4.
Figure 4:
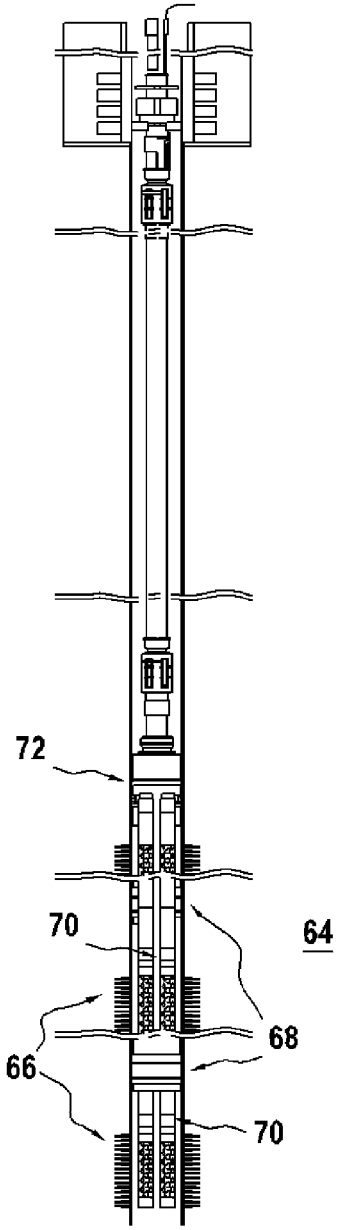
FIG. 4 shows an alternative form of a downhole testing system to that in FIGS. 1 and 3, using a hybrid telemetry system.

FIG. 4 shows an embodiment of the present invention with a hybrid telemetry system. The testing installation shown in FIG. 4 comprises a lower section 64 which corresponds to that described above in relation to FIGS. 1 and 3. As before, downhole equipment 66 and packer(s) 68 are provided with acoustic modems 70. However, in this case, the uppermost modem 72 differs in that signals are converted between acoustic and electromagnetic formats. FIG. 5 shows a schematic of the modem 72. Acoustic receiver and transmitter electronics 74, 76 correspond essentially to those described above in relation to FIG. 2, receiving and emitting acoustic signals via piezo stacks (or accelerometers). Electromagnetic (EM) receiver and transmitter electronics 78, 80 are also shown, each of which having an associated microcontroller 82, 84; however, it should be appreciated, that the EM receiver and transmitter electronics 78, 80 may also share a single microcontroller. A typical EM signal will be a digital signal typically in the range of 0.25 Hz to about 8 Hz, and more preferably around 1 Hz. This signal is received by the receiver electronics 78 and passed to an associated microcontroller 82. Data from the microcontroller 82 can be passed to the acoustic receiver microcontroller 86 and on to the acoustic transmitter microcontroller 88 where it is used to drive the acoustic transmitter signal in the manner described above. Likewise, the acoustic signal received at the receiver microcontroller 86 can also be passed to the EM receiver microcontroller 82 and then on to the EM transmitter microcontroller 84 where it is used to drive an EM transmitter antenna to create the digital EM signal that can be transmitted along the well to the surface. In an alternative embodiment (not shown), the acoustic transmitter and receiver electronics 74, 76 may share a single microcontroller adapted for modulating and demodulating the digital signal. A corresponding EM transceiver (not shown) can be provided at the surface for connection to a control system.

Figure 6:
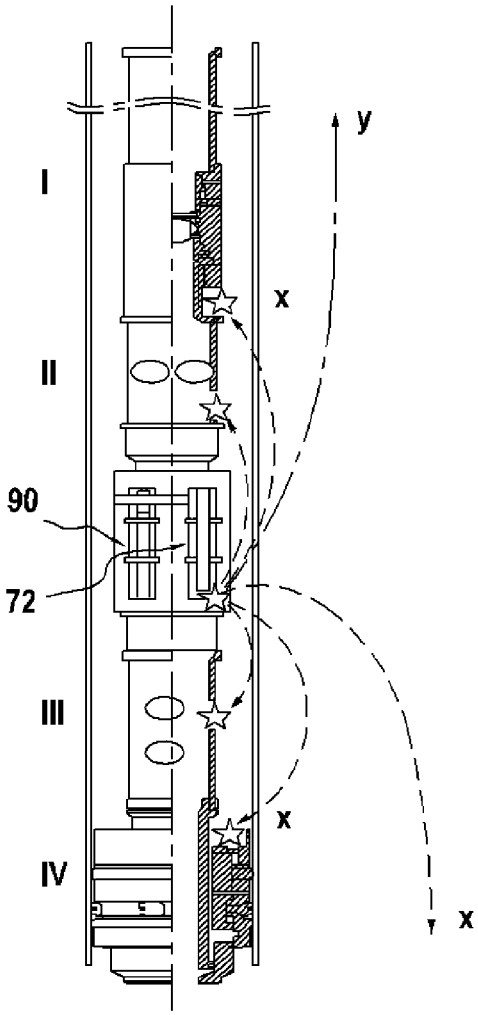
FIG. 6 shows a detailed view of a downhole installation incorporating the modem of FIG. 5.

FIG. 6 shows a more detailed view of a downhole installation in which the modem 72 forms part of a downhole hub 90 that can be used to provide short hop acoustic telemetry X with the various downhole tools 20 (e.g. test and circulation valves (i), flowmeter (ii), fluid analyzer (iii) and packer (iv), and other tools below the packer (iv)), and long hop EM telemetry Y to the surface. It should be understood that while not show, the EM telemetry signal may be transmitted further downhole to another downhole hub or downhole tools.

Figure 7:
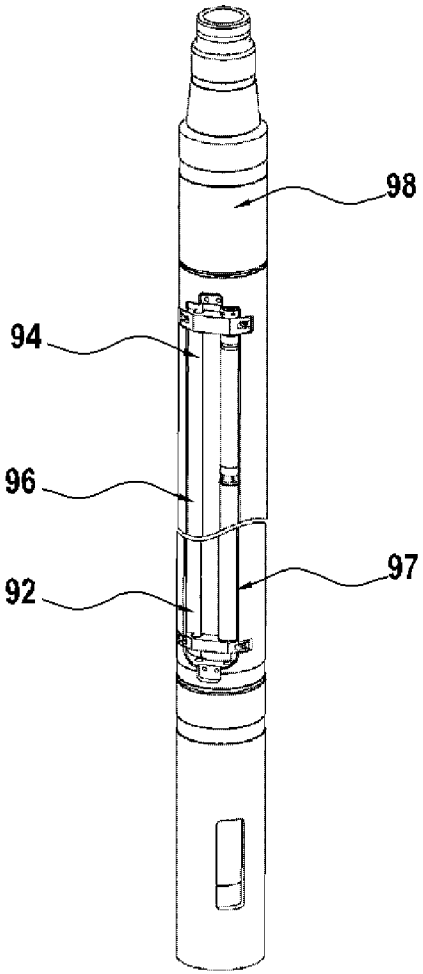
FIG. 7 shows one embodiment of mounting the modem in downhole equipment.

FIG. 7 shows the manner in which a modem can be mounted in downhole equipment. In the case shown, the modem 92 is located in a common housing 94 with a pressure gauge 96, although other housings and equipment can be used. The housing 94 is shown to be positioned in a recess 97 on the outside of a section of tubing 98 provided for such equipment and is commonly referred to as a gauge carrier 97. By securely locating the housing 94 in the gauge carrier 97, the acoustic signal can be coupled to the tubing 98. Typically, each piece of downhole equipment will have its own modem for providing the short hop acoustic signals, either for transmission via the hub and long hop EM telemetry, or by long hop acoustic telemetry using repeater modems. The modem is hard wired into the sensors and actuators of the equipment so as to be able to receive data and provide control signals. For example, where the downhole equipment comprises an operable device such as a packer, valve or choke, or a perforating gun firing head, the modem will be used to provide signals to set/unset, open/close or fire as appropriate. Sampling tools can be instructed to activate, pump out, etc. and sensors such as pressure and flow meters can transmit recorded data to the surface. In most cases, data will be recorded in tool memory and then transmitted to the surface in batches. Likewise tool settings can be stored in the tool memory and activated using the acoustic telemetry signal.

Figure 8:
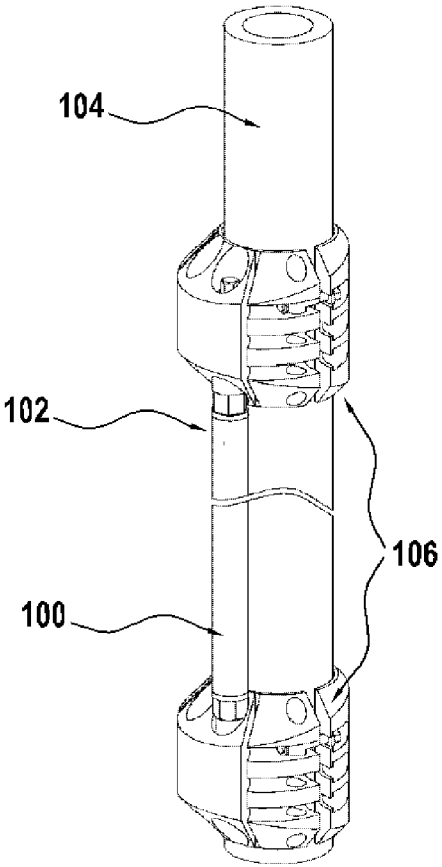
FIG. 8 shows one embodiment of mounting a repeater modem on tubing.

FIG. 8 shows one embodiment for mounting the repeater modem on tubing. In this case, the modem 100 is provided in an elongate housing 102 which is secured to the outside of the tubing 104 by means of clamps 106. Each modem 100 may be a stand-alone installation, the tubing 104 providing both the physical support and signal path.

Figure 9:
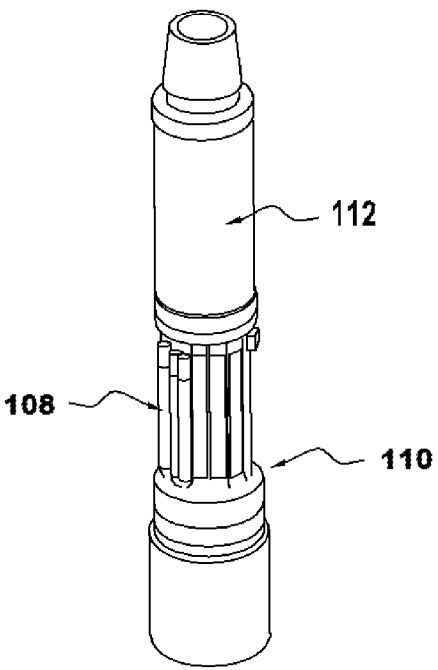
FIG. 9 shows a dedicated modem sub for mounting in tubing.

FIG. 9 shows an alternative embodiment for mounting the repeater modem. In this case, the modem 108 is mounted in an external recess 110 of a dedicated tubular sub 112 that can be installed in the drill string between adjacent sections of drill pipe, or tubing. Multiple modems can be mounted on the sub for redundancy.

Figure 10A:
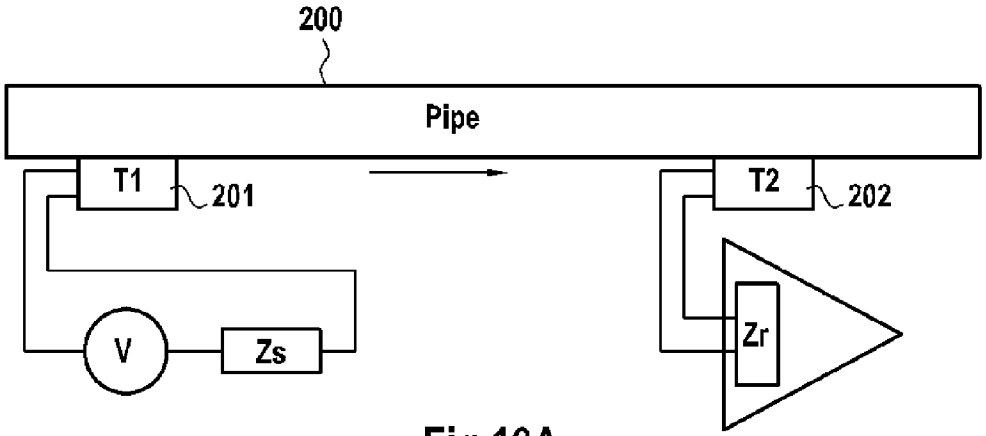
FIGS. 10A and 10B show a schematic view of a two way acoustic communication system, wherein each component is alternatively transmitter and receiver.
Figure 10B:
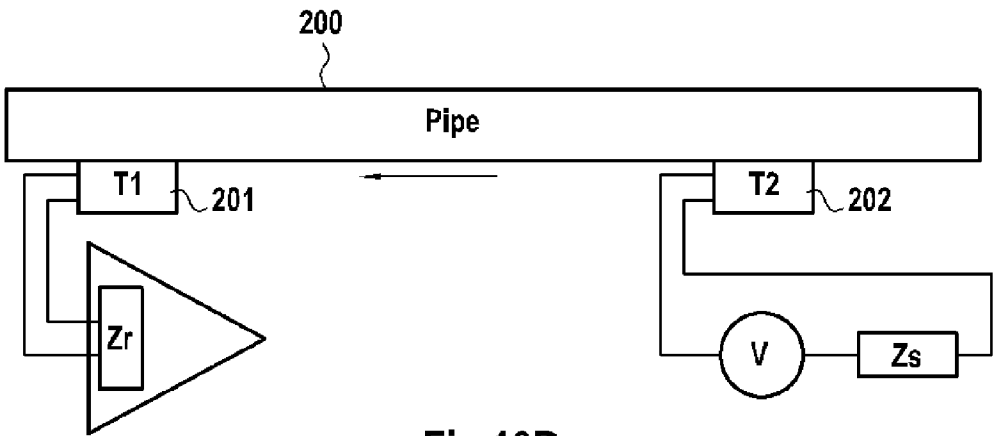

One embodiment of the present invention shown schematically in FIGS. 10A and 10B relates to a bi-directional wireless acoustic communication system wherein data is transmitted along tubing 200 as acoustic waves. The inventive system allows communication of data such as pressure data collected using a pressure gauge downhole to the surface or to a central hub, and commands or control signals transmitted from the surface or the central hub to a downhole piece of equipment such as a valve, as previously described. When the acoustic wave attenuation is too high, repeaters between the two end points of the data transmission system may also be used. Each of the modems 201, 202 of the acoustic telemetry system (downhole, repeaters or surface components) is preferably alternatively transmitter and receiver to enable the two way communication, as represented on FIG. 10, where a single modem is alternatively used to perform both transmission and receiving functions.

Figure 11:
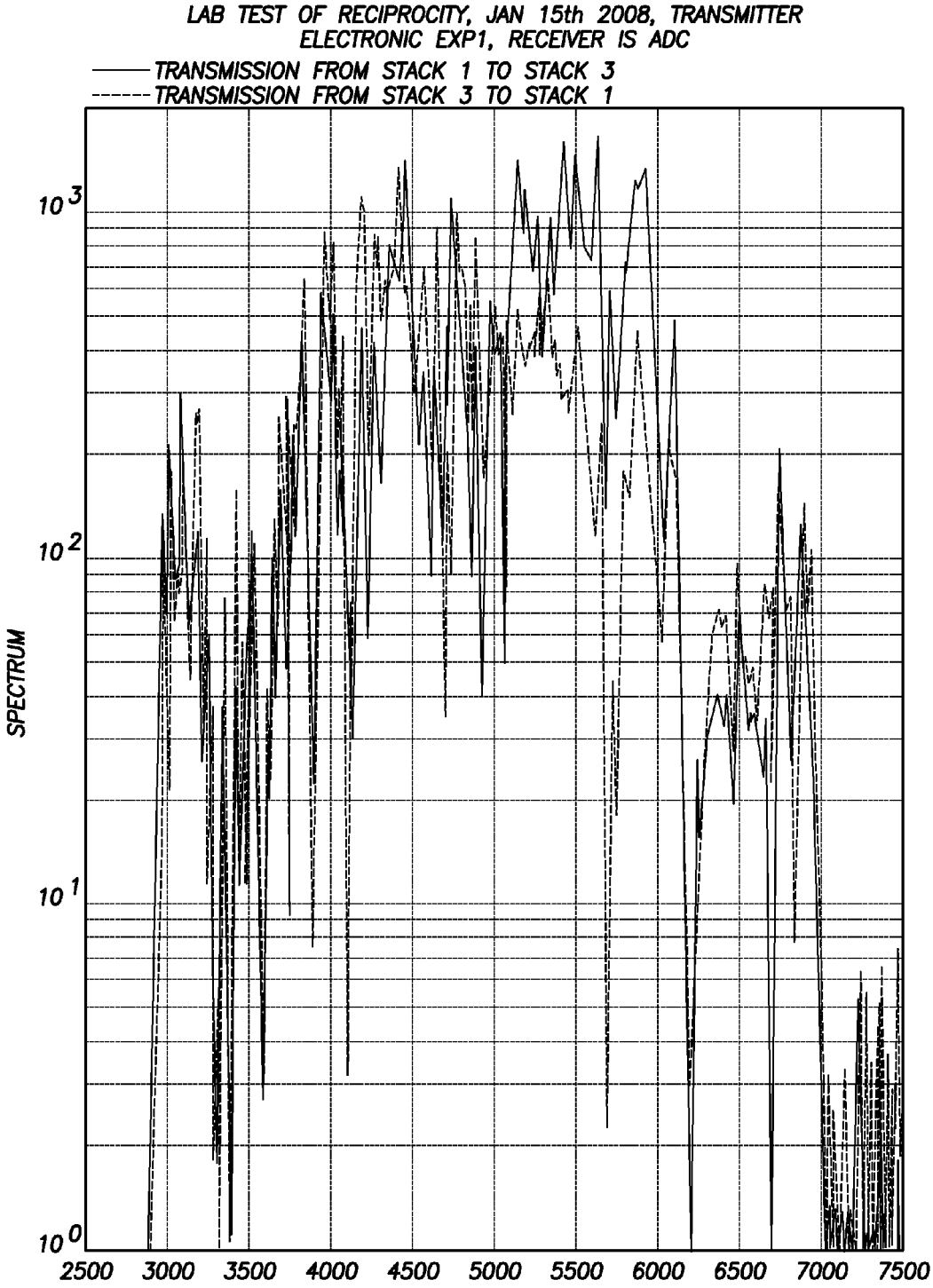
FIG. 11 shows the acoustic channel responses in the up and down directions, in a system as described on FIG. 10.

The characteristic of the acoustic propagation along tubing is such that the frequency response of the acoustic channel is complex, as shown in FIG. 11. The spectrum has many peaks and troughs which are difficult to predict before hand. Choosing a peak for the modulation frequency of the communication is advantageous in terms of signal to noise ratio, where noise is incoherent with the signal and either acoustic or electronic in nature. Choosing a frequency domain with a flat response is advantageous to maximize the bit rate. In any case, choosing the frequency in situ is preferred. However, the process of choosing the right frequency may take time and computing resources. Thus, it is important that selection of the right frequency is as simple as possible.

When the communication direction is reversed, the piezoelectric transducer, for example 201, which was transmitter (FIG. 10A) becomes a receiver (FIG. 10B), and vice versa. The inventors have discovered that the channel response is not identical when the direction of communication is reversed, which in turn complicates the selection of the right frequency. This is the case even with so called identical transducers as demonstrated in FIG. 11. Specifically, FIG. 11 presents two responses which have been acquired with an apparatus similar to that of FIG. 10. The first response is for transmission from T1 to T2, while the second one is from T2 to T1, both transducers remaining untouched. The transmitting electronics and the receiving electronics were physically swapped. Comparison of the two responses shows noticeable differences, which would normally require two different modulation frequencies for the up and down directions, and thus significantly increase the time and complexity for establishing a full operational network. The explanation for the differences between the two responses can be found in the so called reciprocity relations. The relations stipulate that for the general case, the response does not change if transducers T1 and T2 are identical. In practice, however, the transducers T1 and T2 are not identical, for example due to manufacturing tolerances. The present invention avoids this problem by providing a simple method and device for ensuring identical, or near-identical, channel response in the up and down directions. The applicant has discovered that if the electronic transmitter output impedance Zs (shown in FIGS. 10A and 10B) and the electronic receiving circuit impedance Zr (shown in FIGS. 10A and 10B) are identical, then the channel spectral responses are identical. This is the case even for dissimilar transducers.

The solution presented herein is somewhat counterintuitive to acoustic telemetry standard practice where the power amplifier used to drive the transmitter typically has a low impedance while the receiving amplifier (or signal conditioning amplifier) typically has a high impedance. Thus, the present invention provides a unique method and system for matching the channel responses in the up and down directions. Matching the electrical impedances Zs and Zr, is a simple, economical way to ensure identical responses in the up and down directions.

While the present invention has been described with respect to a limited number of embodiments, those skilled in the art, having benefit of this disclosure, will appreciate that other embodiments can be devised which do not depart from the scope of the present invention as disclosed herein. Accordingly, the scope of the present invention should be limited only by the attached claims.

What is claimed is:

1. A bi-directional acoustic telemetry system for communicating data and/or control signals between a first modem and a second modem along tubing, the system comprising:

a bi-directional communication channel comprising:

the tubing, a transducer of the first modem, and a transducer of the second modem, wherein the transducer of each modem is configured to transmit and receive said data and/or control signals, and wherein the transducer of each modem is further configured to electrically communicate with a power amplifier characterized by an output impedance Zs and a signal conditioning amplifier characterized by an input impedance Zr; and wherein the power amplifier and the signal conditioning amplifier are configured so that the output impedance Zs matches the input impedance Zr to achieve a matched spectral response in communications in both directions of the communication channel along the tubing between the first modem and the second modem.

2. The bi-directional acoustic telemetry system of claim 1, wherein the output impedance Zs and the input impedance Zr are identical.

3. The bi-directional acoustic telemetry system of claim 1, wherein each said modem comprises:

a first electro-active element for transmitting said data and/or control signals;

transmitter electronics for driving said first electro-active element to create an acoustic signal;

a second electro-active element for receiving said data and control signals; and receiver electronics for prompting said second electro-active element to receive acoustic signals.

4. The bi-directional acoustic telemetry system of claim 3, wherein the first electro-active element is a piezoelectric stack.

5. The bi-directional acoustic telemetry system of claim 3, where the second electro-active element is a monitoring piezoelectric stack or an accelerometer.

6. The bi-directional acoustic telemetry system of claim 3, wherein the transmitter electronics comprise an interface for providing an electrical output signal from a sensor, a microcontroller which modulates the signal to derive a modulated signal, a signal conditioning amplifier to modify the modulated signal to match the characteristics of the first electro-active element and to apply a drive signal to the first electro-active element so as to generate the acoustic signal which corresponds to the electrical output signal from the sensor.

7. The bi-directional acoustic telemetry system of claim 6, wherein the acoustic signal comprises a carrier signal with an applied modulation that passes along the tubing as a longitudinal and/or flexural wave.

8. The bi-directional acoustic telemetry system of claim 7, wherein the acoustic signal has a frequency in the range 1-10 kHz, preferably in the range 2-5 kHz.

9. The bi-directional acoustic telemetry system of claim 3, wherein the receiver electronics are arranged to receive an analog signal carrying digital information and comprise a filter to which the signal is applied, an A/D converter to provide a digital signal, and a microcontroller for signal processing.

10. The bi-directional acoustic telemetry system of claim 3, wherein each said modem comprises a housing supporting the first and second electro-active elements, the transmitter and receiver electronics.

11. The bi-directional acoustic telemetry system of claim 10, wherein the housing further supports a battery to provide power to said receiver and transmitter electronics.

12. The bi-directional acoustic telemetry system of claim 1, further comprising at least one repeater modem operating to receive an acoustic signal generated by a preceding modem and to amplify and retransmit the acoustic signal for further propagation.

13. The bi-directional acoustic telemetry system of claim 1, wherein the downhole modem further comprises electromagnetic receiver and transmitter electronics and a first and second microcontroller associated with said electromagnetic receiver and transmitter electronics adapted for electromagnetic communication with an electromagnetic receiving device provided at the surface.

14. The bi-directional acoustic telemetry system of claim 1, wherein the downhole modem is located in a common housing with downhole equipment.

15. The bi-directional acoustic telemetry system of claim 1, wherein the downhole modem is provided in an elongate housing secured to the outside of the tubing.

16. A testing installation for a well comprising:

a well-head equipment, a tubing which extends from the well-head equipment down inside the well to the zone of interest and downhole equipment connected to the tubing, and a bi-directional acoustic telemetry system for communicating between downhole equipment and the well-head equipment, the bi-directional acoustic telemetry system comprising:

a first modem having a transducer; and a second modem having a transducer, wherein the transducer of each modem is configured to transmit and receive data and/or control signals along the tubing, wherein the transducer of each modem is further configured to electrically communicate with a power amplifier characterized by an output impedance Zs and a signal conditioning amplifier characterized by an input impedance Zr; and wherein the power amplifier and the signal conditioning amplifier are configured so that the output impedance Zs matches the input impedance Zr to achieve a matched spectral response in communications between the first modem and the second modem in both directions of a bi-directional communications channel along the tubing.

17. A method for bi-directional acoustic communication between a first modem and a second modem along tubing, wherein each said modem comprises a transducer for transmitting and receiving acoustic signals, the method comprising the steps of:

determining an output impedance Zs of each modem;

determining an input impedance Zr of each modem;

matching the determined output impedance Zs of each modem with the determined input impedance of each modem;

transmitting an acoustic signal from the first modem to the second modem along the tubing, where the output impedance Zs of the first modem has been matched with the input impedance Zr of the second modem; and transmitting an acoustic signal from the second modem to the first modem along the tubing, where the output impedance Zs of the second modem has been matched with the input impedance Zr of the first modem.

18. The method of claim 17, wherein each said modem comprises a power amplifier for generating an acoustic signal, and a signal conditioning amplifier for sensing reception of an acoustic signal, and wherein the output impedance Zs is associated with the power amplifier, and the input impedance Zr is associated with the signal conditioning amplifier.

19. A bi-directional acoustic telemetry system for communicating data and/or control signals between a first modem and a second modem along tubing, comprising:

a first modem; and a second modem, wherein each said modem comprises a transducer for transmitting and receiving said data and control signals, and wherein the transducer of each said modem is configured to electrically communicate with:

a power amplifier characterized by an output impedance Zs for driving said data and/or control signal, and a signal conditioning amplifier characterized by an input impedance Zr for receiving said data and/or control signal, wherein the power amplifier and the signal conditioning amplifier are configured so that the output impedance Zs and the input impedance Zr provide for a bi-directional communication channel along the tubing between the first and second modems having a reciprocal spectral response in both directions of communication between the first and second modems.

* * * * *